United States Patent [19]

Nelson

[11] Patent Number: 4,819,538

[45] Date of Patent: Apr. 11, 1989

[54] FLUTES

[76] Inventor: Harold Nelson, 104 Executive Dr., Manhasset Hills, N.Y. 11040

[21] Appl. No.: 148,045

[22] Filed: Jan. 25, 1988

[51] Int. Cl.[4] ..... G10D 7/02

[52] U.S. Cl. ..... 84/384

[58] Field of Search ..... 84/380, 384

[56] References Cited

U.S. PATENT DOCUMENTS

| | | | |
|---|---|---|---|
| 901,913 | 10/1908 | Julliot | 84/384 |
| 1,586,794 | 6/1926 | Gage | 84/384 |
| 4,376,403 | 3/1983 | Haedrich et al. | 84/384 |
| 4,763,556 | 8/1988 | Peplowski | 84/384 |

*Primary Examiner*—Lawrence R. Franklin

[57] ABSTRACT

Novel flutes based on present-day standard flutes devised long ago by Boehm have a finger piece for the key of the C-sharp venting hole over the key for the B venting hole, thus being close to the B-sharp venting hole and its key.

5 Claims, 2 Drawing Sheets

FLUTES

This invention relates to flutes of either the C or B-foot model, not to alto flutes or piccolos.

Both C- and B-foot flutes comprise a tube closed at one end, an embouchure hole near the closed end, and a series of normally open tone holes distributed along the length of the tube at locations critically related to tones to be produced. A key cup or "key" at each tone hole can be depressed to close the hole. The pitch produced when the performer starts the air moving from the embouchure hole depends on the combination of tone holes that are closed or "stopped" by depressed keys.

The holes are not distributed in an order that is totally logical in relation to the performer's fingers. To assist in developing a more rational relationship between the natural sequence of the performer's fingers and the keys, finger pieces are provided which are mechanically coupled to some of the keys. The finger pieces and the keys which they operate may be far apart. Moreover, mechanisms are provided to depress two or more keys using only one finger. A comprehensive fingering system was developed about 1850, the Boehm system. That system has been in use universally for well over a century with little change.

Many flutists have experienced acute pain in the left wrist and forearm after long, and even short, periods of practice or performance. What is called the dorsaflexis position of the left hand has been identified as the cause of anxiety, emotional problems, fatigue, nerve damage, coordination problems and carpel tunnel syndrome. Some conditions require wearing a splint during weeks of rest; even surgery has proved necessary on occasion. Indeed, the resulting permanent physical injury and suffering have forced involuntary retirement on many professional flutists.

The present invention provides a modification of the heretofore standard flute, for meeting the problem. Underlying the invention is the realization that the traditional left-hand finger positions can be altered and how they should be altered to avoid the problem.

In novel flutes embodying the invention, the usual finger piece for operating the key of the C-sharp hole is replaced. A new finger piece is located above the key for the B venting hole in the otherwise standard flute. The new finger piece is fully an inch closer to the key of the B-flat venting hole than in the classical flute. This is the key that is depressed directly by the left-hand middle finger, so that the separation of the left-hand forefinger from the middle finger is reduced from two inch to one inch. The novel finger piece is also shifted upward about ¼ inch from the level of the prior finger piece, so that moving the left-hand forefinger for depressing the new finger piece is still more natural and easy to perform.

In the hands of a professional flutist who experienced acute left-hand suffering in using the heretofore standard flute, the improved flute opened up a whole new future. That flutist underwent corrective surgery for repairing left-hand damage incurred in using the standard flute. After recovering from the surgery, that flutist has been using the novel flute for prolonged sessions without even a hint of the previous pain.

The damaging experience of this flutist in using the standard flute and the many recently reported cases of left-hand trauma of flutists is no new condition, i.e., both the flute construction and the anatomy of flutists' left hands have remained unchanged since introduction of that flute circa 1850. Accordingly, the invention meets a long-felt want.

The nature of the invention will be better appreciated from the following detailed description of the novel flute in relation to the standard flute, both being shown in the accompanying drawings. In the drawings.

Figure 6:
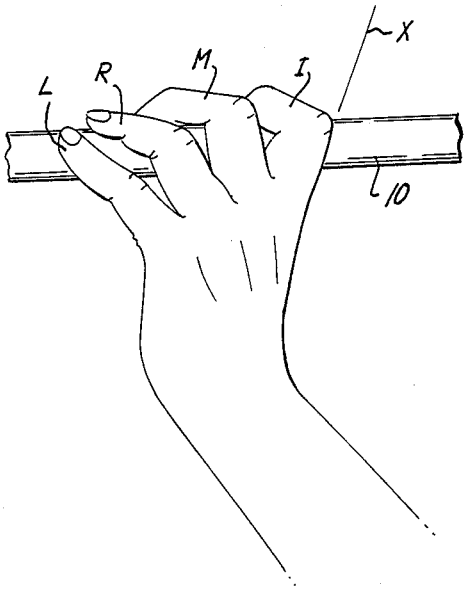
Figure 7:
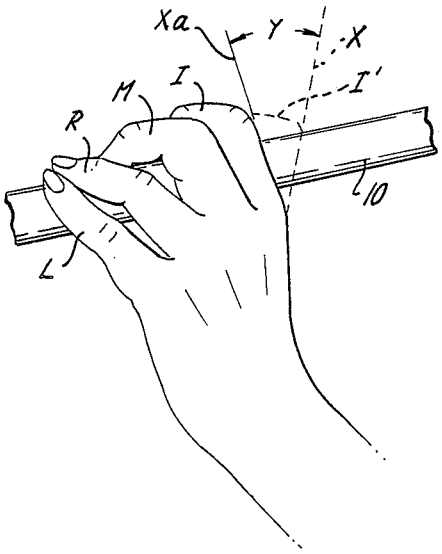
Figure 8:
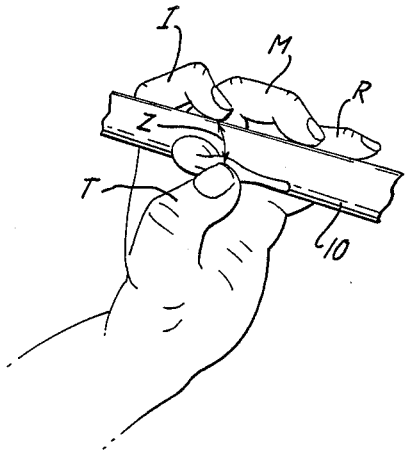
Figure 9:
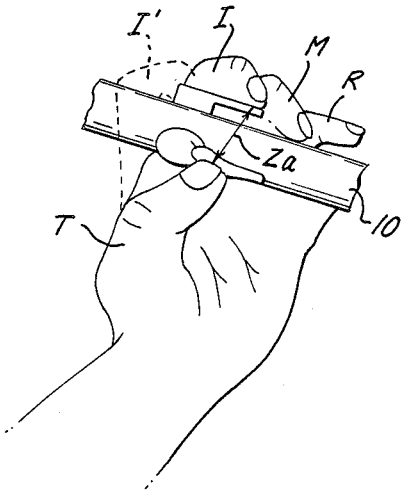

FIGS. 6 and 7 are comparative views of a flutist's left hand when using a classical flute and when using the novel flute, including a diagrammatic portion of each flute; and FIGS. 8 and 9 are comparative views of a flutist's left hand corresponding to FIGS. 6 and 7 but viewed from the opposite side of the flute.

Referring now to the drawings, the classical flute and the novel flute are described using the same numbers to represent identical parts.

A tube 10 is shown, being two assembled sections of the flute. The three sections of a complete flute are connected to each other by telescopic joints. (The third section is omitted from the drawings, as noted above.)

The first section has a closed end 12 and an embouchure hole 14. There are holes distributed along the top and along one side of the tube which are normally open but which are closed by depressing key cups or "keys". Keys of a flute may be designated in various ways. The keys are identified here as being for the hole that is closed when that key is depressed. Thus, the first, second and third venting holes distributed along the top of the flute are the C-sharp, B, and B-flat holes. The keys that are over those holes are here designated 16 (C#), 18 (B) and 20 (B-flat).

Many of the keys of the flute are depressed directly by the flutist's fingers. Others are depressed by a finger piece that is mechanically coupled to one or more of the keys. Thus, finger piece 22 in the classical flute shown in FIG. 2 is coupled mechanically to key 16 (C#). This finger piece is to be depressed by the left-hand index finger of the flutist. Other finger pieces 24 and 26 are arranged at the side of the flute shown in FIG. 1, for operation by the flutist's left-hand thumb. Key 18 (B) is operated by various finger pieces; notably no finger is positioned to depress this key directly. The flutist's left-hand middle finger is positioned over key 20 (B-flat) and the ring finger is positioned over key 28 (A).

Figure 1:
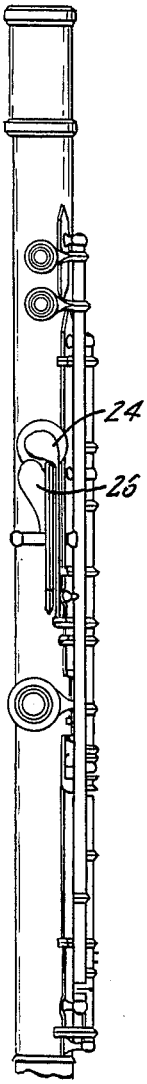
FIG. 1 is a side elevation of the middle section of a classical three-section flute.
Figure 2:
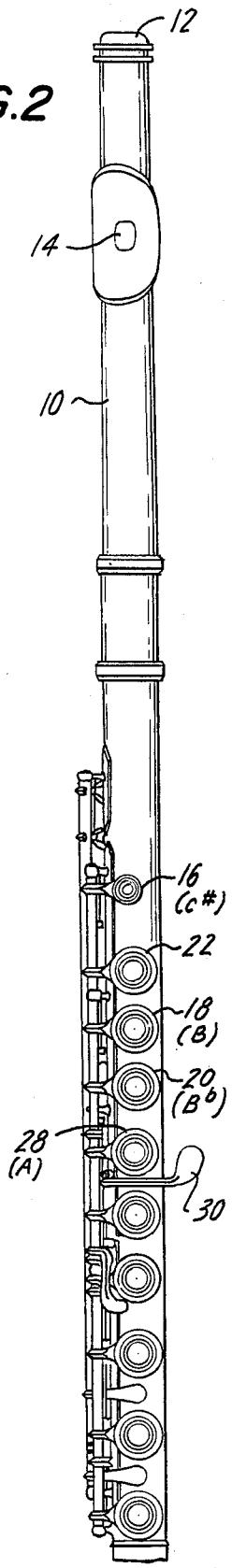
FIG. 2 is the top plan view of the first and second sections of a flute that includes the section of FIG. 1, the third section being omitted for avoiding an excessively small scale that would be needed to show the complete flute.
Figure 3:
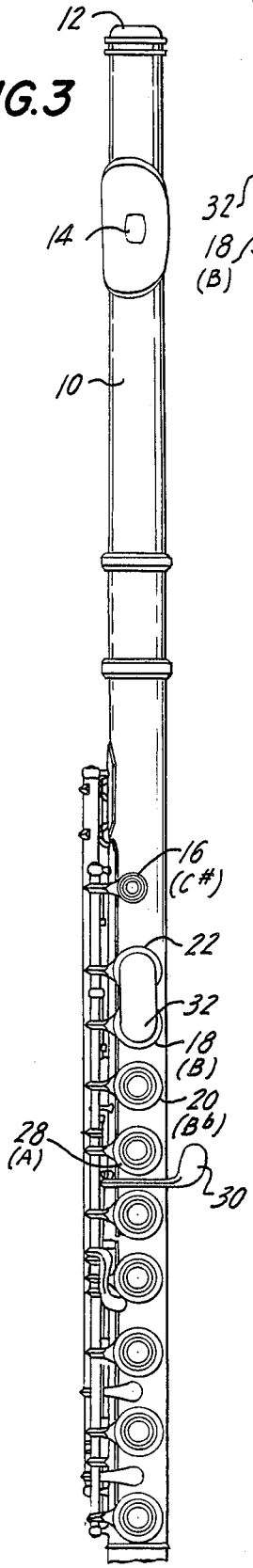
FIG. 3 is a top plan view of a flute embodying features of the invention.
Figure 5:
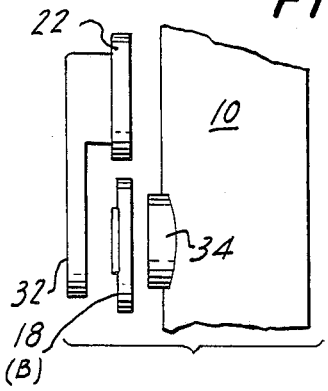
FIG. 5 is a right-side elevation of a portion of FIG. 4.
Figure 4:
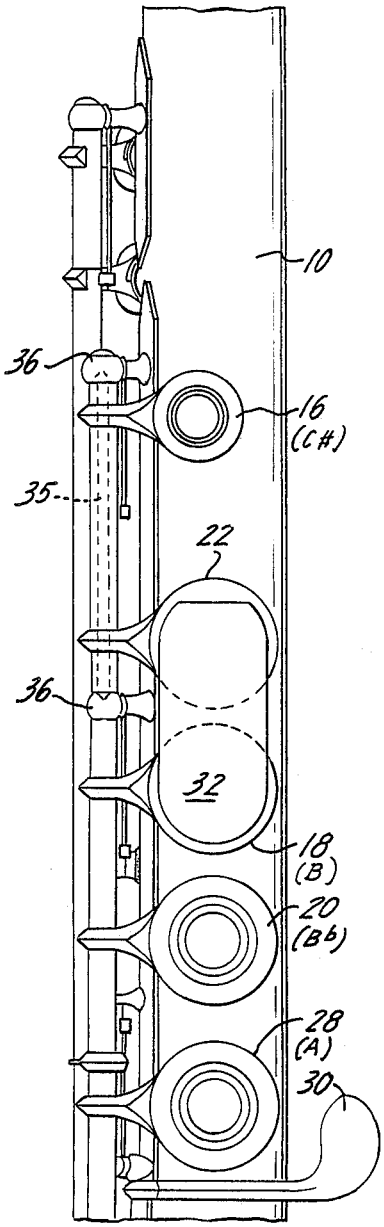
FIG. 4 is a fragment of FIG. 3, drawn to enlarged scale.

FIGS. 3–5 are various views of a novel flute, being the flute of FIGS. 1 and 2 modified to incorporate the invention. FIG. 1 represents one side of the novel flute inasmuch as the modification does not affect that side view. Parts that are the same in FIGS. 3–5 and in FIG. 2 bear the same numbers; their description is not repeated.

With particular reference to FIGS. 4 and 5, an extension is fixed to finger piece 22, to constitute a new finger piece 32, disposed directly over key 18 (B). There is a space of 3/16-inch (see FIG. 5) between finger piece 32 and key 18(B). This key or key cup is $\frac{1}{8}$-inch thick; it is spaced $\frac{1}{8}$-inch from the short tube or "chimney" 34 surrounding venting hole B. Key 18 (B) is pressed against chimney 34 by a finger piece (not shown) as described above. Finger piece 32, when depressed for stopping the C# venting hole, does not reach or depress key 18.

Finger piece 22 operates on a shaft 35 that is pivoted in posts 36 that are fixed to tube 10. Both in the novel flute and in the prior flute, a spring (not shown) biases key 16 and finger piece 22 upward, to a fixed stop (not shown). The same parts bias finger piece 32 upward and determine its raised position. It is contemplated that a single newly shaped finger piece extending from the space over key 18 to pivot shaft 35 will replace the composite parts 22/32.

The area of finger piece 32 engaged by the finger tip of the index finger is over key 18 which is centered $\frac{7}{8}$ inch from the center of key 20. This is in contrast to the $1\frac{5}{8}$ inch center-to-center spacing between finger piece 22 and key 20. This contrasting dimension is highly significant, as demonstrated by FIGS. 6–9 where the left-hand index finger I, middle finger M, ring finger R, little finger L and thumb T are shown in their relative positions needed to operate each of the two flutes.

In FIGS. 6 and 8, the flutist's left hand is in its position resulting from all of the constraints imposed on the flutist when playing the prior flute, with the embouchure hole positioned at the mouth, etc. The tip of the index finger I is drawn back $1\frac{5}{8}$ inches from the tip of the middle finger M, with the result that the first segment of index finger I extends along line X in FIG. 6. The large separation between the tips of the index finger I and the middle finger M for playing the prior flute is prominent in FIG. 8.

FIGS. 7 and 9 represent the flutist's left hand, with the fingers in their playing positions relative to the flute of FIGS. 1 and 3–5. The first segment of the index finger I is shown in FIG. 7 extending along line Xa. The finger tip of the index finger in FIG. 9 is much closer to the middle finger tip. The dotted line representation of the index finger in FIG. 7 replicates its position in FIG. 6. The first segment of the index finger is retracted much less in FIG. 7 than in FIG. 6, with the result that angle Y represents the reduced angle that the first segment of the index finger must be retracted from the middle finger in playing the novel flute as compared to the prior flute.

FIG. 9 shows, in solid lines, the positions of the finger tips in playing the novel flute. The tips of fingers I and M are quite close to each other. The contrast between FIGS. 8 and 9 in this respect is striking. Less evident is the contrast between the relationships of the thumb and the index finger. A person's hand is well adapted to the basically important function of gripping. In FIG. 8, the index finger is spaced along line Z from thumb I. Physiologically, the index finger is poorly adapted to develop pressure toward thumb I in FIG. 8. In contrast, the index finger I in FIG. 9 is positioned ideally for developing squeezing pressure toward thumb T (line Za). The motions required of a person's index finger in depressing finger pieces 22 and 32 are similarly in sharp contrast. The finger motion for depressing finger piece 22 is quite unnatural; the motion for depressing finger piece 32 is most natural.

A further subtle consideration should be recognized. The tip of the index finger on finger piece 32 is raised about $\frac{1}{4}$-inch in relation to the tip of the middle finger M on key 20. Finger piece 32 is raised $\frac{1}{4}$-inch above the level of keys 18, 20, 22 and 28. With fingers M, R and L curled around the flute, the index finger's raised position is a distinct advantage. This is best appreciated by a person actually positioning the left hand as in FIGS. 7 and 9, with the index finger raised as shown, compared to the same finger distribution but with the tip of the index finger lowered to be at the same level as the tip of the middle finger.

Flutists have been subjected to the ordeal of positioning their left-hand fingers as shown in FIGS. 6 and 8 since the introduction of the Boehm flute, nearly 150 years ago. The changed flute construction of FIGS. 3–5, allowing for the much more natural finger positions of FIGS. 7 and 9, is long overdue. What is involved is no mere matter of comfort or convenience—although the change would have been warranted long ago for that reason alone. The physiological consequences of the prior construction have been so very serious that the novel flute represents an important advance in flute construction.

What is claimed is:

1. A flute having an elongated tube closed at one end; an embouchure hole in the tube near its closed end; normally open venting holes and keys therefor distributed along the tube and finger pieces for operating certain of said keys; said venting holes including a series at the same side of the tube as the embouchure hole; the first four of said series of said venting holes in their sequence starting nearest the embouchure hole being the C-sharp, B, B-flat and A venting holes, the keys of said B-flat and A venting holes being operable directly by the middle finger and the ring finger of the left hand, respectively, one of said finger pieces being spaced from but coupled to the key of the C-sharp venting hole, characterized in that the last-named finger piece has a portion disposed over and spaced from the key of the B venting hole for engagement by the left-hand forefinger.

2. A flute as in claim 1, wherein the keys of the B-flat and A venting holes have finger-engageable surfaces at a common level, further characterized in that said portion of the last-named finger piece which is over the B venting hole has a finger engageable surface that is spaced $\frac{1}{4}$-inch above said common level.

3. A flute as in claim 1, wherein said B and B-flat venting holes and their keys are centered $\frac{7}{8}$-inch apart and wherein such keys have outer surfaces at a common level, further characterized in that said portion of the finger piece coupled to the C-sharp key has a finger engageable surface that is within $\frac{7}{8}$-inch from the key of said B-flat venting opening and is disposed $\frac{1}{4}$-inch above said common level.

4. A Boehm-type flute of the class consisting of the C-foot and B-foot flutes, which includes a tube closed at one end and having an embouchure hole at a side of the tube near the closed end, normally open venting holes and keys therefor distributed along the tube, and finger pieces for operating certain of said keys, the finger pieces being mechanically coupled to the keys which they operate but being spaced along the tube from said keys, respectively, a series of said venting holes and their keys being distributed along the same side of the tube as said embouchure hole, said series of venting holes in their sequence starting nearest the embouchure hole being the C-sharp, B, B-flat and A venting holes, the keys of the B-flat and A venting holes being operable directly by the middle finger and ring finger, respectively, of the flutist's left hand and the key of the C-sharp venting hole being mechanically coupled to and spaced along the tube from one of said finger pieces, characterized in that the last-named finger piece has a portion disposed over and spaced from the key of the B venting hole for operation by the flutist's left-hand index finger.

5. A flute as in claim 4, the keys of said B and B-flat venting holes having upper surfaces at a common level, wherein said portion of said finger piece that is disposed over the key of the B venting hole has a finger engageable surface that is spaced ¼-inch above said common level.

* * * * *